US007717867B2

(12) United States Patent
Nan

(10) Patent No.: US 7,717,867 B2
(45) Date of Patent: May 18, 2010

(54) MASSAGE APPARATUS WITH POSITIONAL SET-UP ACTUATOR

(75) Inventor: Simon Siu Man Nan, Richmond Hill (CA)

(73) Assignee: Nanma Manufacturing, Co., Ltd., Hong Kong (HK)

( * ) Notice: Subject to any disclaimer, the term of this patent is extended or adjusted under 35 U.S.C. 154(b) by 882 days.

(21) Appl. No.: 11/581,264

(22) Filed: Oct. 16, 2006

(65) Prior Publication Data

US 2008/0091127 A1 Apr. 17, 2008

(51) Int. Cl.
*A61H 1/00* (2006.01)

(52) U.S. Cl. ..... 601/46; 601/60; 601/72; 600/38

(58) Field of Classification Search ..... 601/46, 601/60, 67, 69, 70, 72, 73, 78, 80; 600/38
See application file for complete search history.

(56) References Cited

U.S. PATENT DOCUMENTS

| | | | | |
|---|---|---|---|---|
| 6,190,307 | B1 * | 2/2001 | Tsai | 601/46 |
| 7,081,087 | B2 * | 7/2006 | Jannuzzi | 600/38 |
| 7,341,566 | B2 * | 3/2008 | Nan | 601/72 |
| 2002/0188233 | A1 * | 12/2002 | Denyes | 601/46 |

* cited by examiner

*Primary Examiner*—Quang D Thanh
(74) *Attorney, Agent, or Firm*—Polsinelli Shughart PC

(57) ABSTRACT

A massage apparatus having a main unit in operative association with a first massage actuator and a second massage actuator is disclosed. A hollow prosthetic member having a plurality of annular protrusions encases the first massage actuator, while the second massage actuator may be engaged to a detachable connecting ribbon that may be secured to different portions of the plurality of annular protrusions in order to change the position of the second massage actuator relative to the first massage actuator.

16 Claims, 3 Drawing Sheets

MASSAGE APPARATUS WITH POSITIONAL SET-UP ACTUATOR

FIELD

The present document relates to a massage apparatus having multiple massage actuators, and more particularly to a massage apparatus having a massage actuator that may be positionable relative to another fixed massage actuator.

SUMMARY

In an embodiment, the massage apparatus may include a main body, the main body being operatively associated with a first massage actuator and a second massage actuator, a hollow prosthetic member adapted to be engaged to the main unit and encase the first massage actuator, the hollow prosthetic member defining a plurality of annular protrusions, and a detachable connecting ribbon engaged to the second massage actuator, the detachable connecting ribbon being adapted for engagement with one or more of the plurality of annular protrusions, wherein the detachable connecting ribbon is engageable with the plurality of annular protrusions such that the position of the second massage actuator may be changed relative to the first massage actuator.

In another embodiment, the massage apparatus may include a main body, the main body operatively associated with a first massage actuator and a second massage actuator, the main unit in operative engagement with a removable battery compartment, the removable battery compartment including a control panel that controls the operation of massage apparatus when the removable battery compartment is operatively engaged to the main unit, a hollow prosthetic member adapted to encase the first massage actuator, the hollow prosthetic member defining a plurality of annular protrusions, and a detachable connecting ribbon engageable to the second massage actuator, the detachable connecting ribbon includes a strap adapted for engagement with the plurality of annular protrusions, wherein the strap may be engaged to any portion of the plurality of protrusions such that the position of the second massage actuator may be changed relative to the main body.

In yet another embodiment, a method of positioning a massage actuator on a massage apparatus may include:

a) providing a massage apparatus including a main body, the main body being operatively associated with a first massage actuator and a second massage actuator, a hollow prosthetic member adapted to be engaged to the main unit and encase the first massage actuator, the hollow prosthetic member defining a plurality of annular protrusions, and a detachable connecting ribbon including a strap, the strap being engaged to a portion of the plurality of annular protrusions for maintaining the second massage actuator in a first position;

b) disengaging the detachable connecting ribbon from the portion of the plurality of annular protrusions; and c) engaging the detachable connecting ribbon to another portion of the plurality of annular protrusions for maintaining the second massage actuator in a second position.

Implementation of the above embodiments may include one or more of the following features:

The main body defines a chamber adapted to operatively engage a removable battery compartment, the removable battery compartment including at least one battery for providing power to the massage apparatus and a control panel for controlling the operation of the first and second massage actuators when the removable battery compartment is operatively engaged to the main unit.

The detachable connecting ribbon includes a strap, the strap having a VELCRO or hook-and-loop tape portion for engaging the detachable connecting ribbon to the plurality of annular protrusions.

The detachable connecting ribbon further includes a carrying base, the carrying base having a connection member defining a slot adapted to engage the strap, the carrying base further including a seat adapted to engage the second massage actuator.

The second massage actuator is a vibration massage actuator, the second massage actuator including an electric motor, the electric motor having a rotating shaft operatively engaged to an eccentric mass for spinning the eccentric mass.

The electric motor is encased inside an upper shell engaged to a lower shell, the upper shell and the lower shell being adapted to be encased inside another prosthetic member.

The second massage actuator is operative engaged to a cable for operatively associating the first massage actuator to the control panel.

The first massage actuator is a squirming/vibration massage actuator.

The first massage actuator further includes a driving unit, the driving unit including a motor having a rotatable motor shaft operatively engaged for spinning an eccentric mass, the motor being operatively engaged to a gearbox for operating the first massage actuator.

The main body is engaged to a hollow tube that surrounds the first massage actuator.

The main unit defines a chamber adapted to receive the removable battery compartment.

Disengaging the detachable connecting ribbon includes disengaging the strap from the portion of the plurality of protrusions.

Engaging the detachable connecting ribbon includes engaging the strap to another portion of the plurality of protrusions.

Additional objectives, advantages and novel features will be set forth in the description which follows or will become apparent to those skilled in the art upon examination of the drawings and detailed description which follows.

BRIEF DESCRIPTION OF THE DRAWINGS

Corresponding reference characters indicate corresponding elements among the view of the drawings.

DETAILED DESCRIPTION

Figure 1:
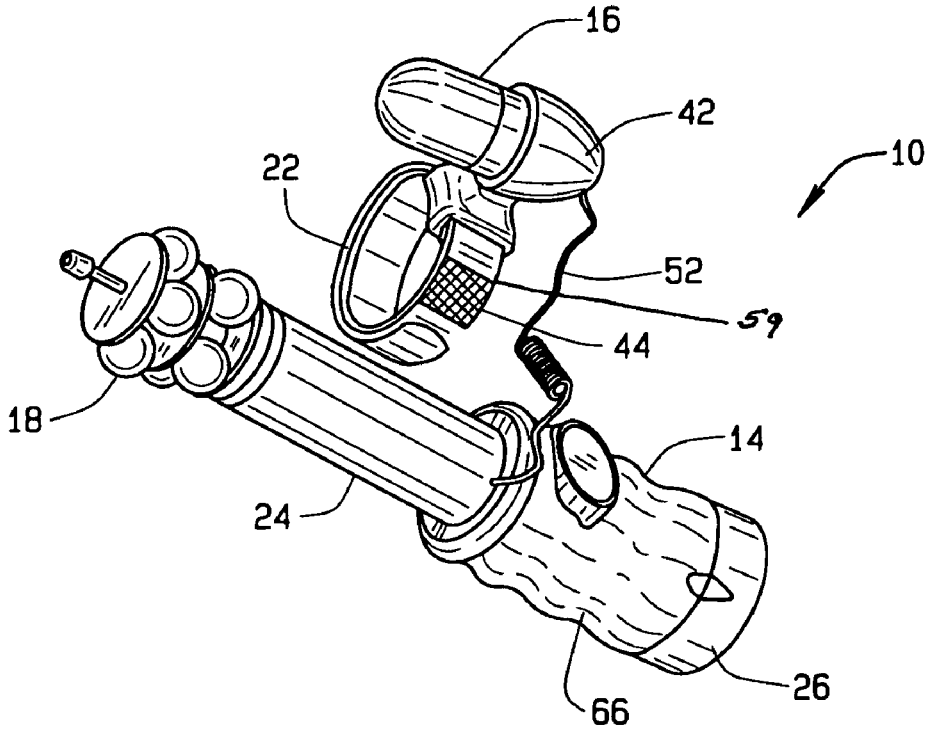
FIG. 1 is a perspective view of the massage apparatus.

Referring to the drawings, a massage apparatus is illustrated and generally indicated as 10 in FIGS. 1-4. In one embodiment, massage apparatus 10 may comprise a main unit 14 operatively associated with a vibration massage actuator 16 and a squirming/vibration massage actuator 18 for providing various massage applications. Main unit 14 may comprise a body 66 operatively engaged to a driving unit 30 disposed inside a hollow tube 24 for operating squirming/vibration massage actuator 18. In addition, the body 66 may define an open end 50 in communication with a chamber (not shown) adapted to receive a removable battery compartment 26 therein.

Referring to FIG. 1, vibration massage actuator 16 may be operatively associated to main unit 14 through a cable 52 that extends through a carrying base 42 of a detachable connecting ribbon 22 that may attach vibration massage actuator 16 along different portions of the massage apparatus 10. The detachable connecting ribbon 22 may include a strap 59 having a VELCRO or hook-and-loop tape portion 44 adapted to engage another portion of strap 59 for securing the detachable connecting ribbon 22 around another portion of massage apparatus 10 as shall be discussed in greater detail below.

Figure 3:
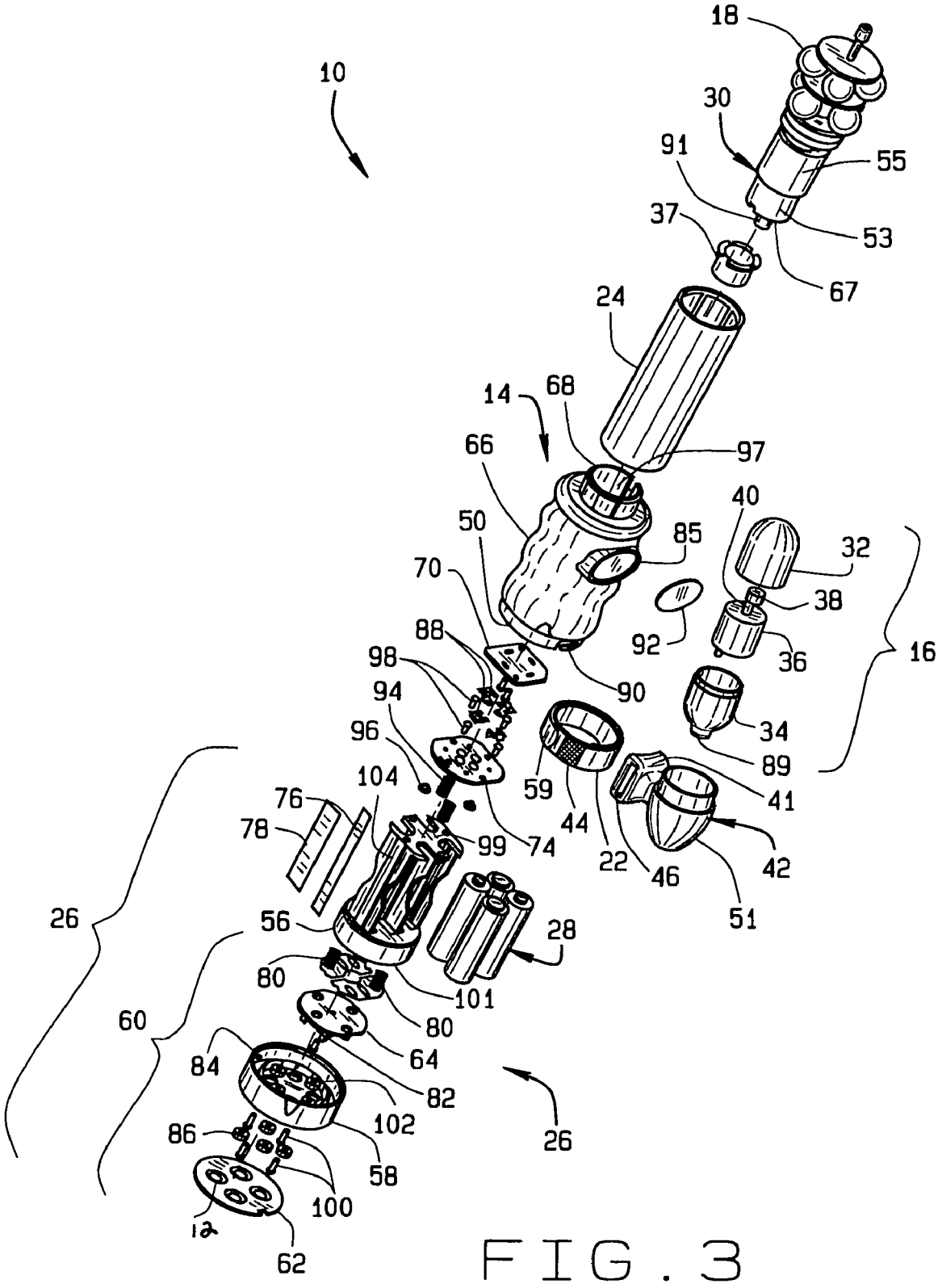
FIG. 3 is an exploded view of the massage apparatus.
Figure 4:
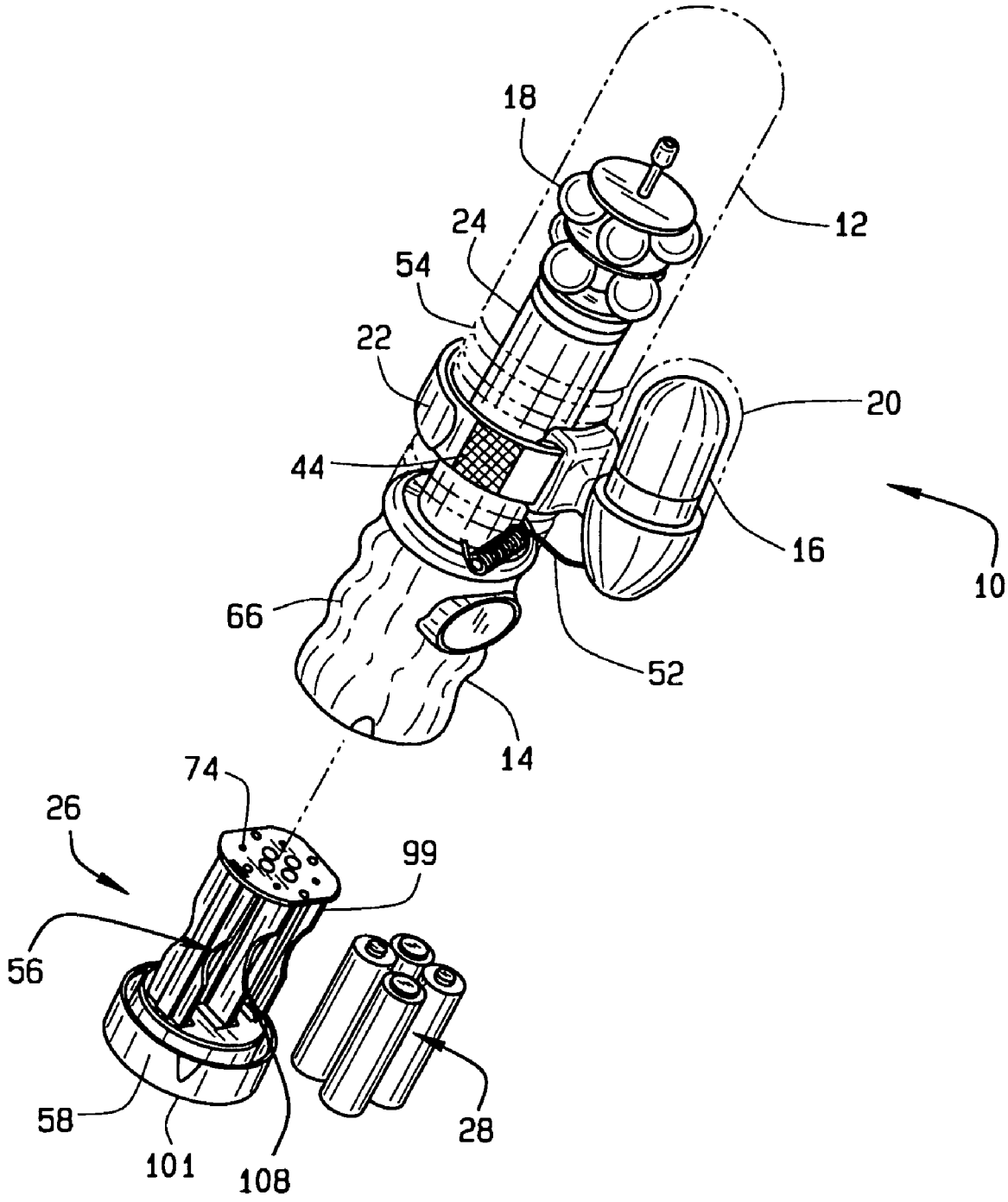
FIG. 4 is a partially exploded perspective view of the massage apparatus showing the removable battery compartment.

The removable battery compartment 26 may be operatively engaged within the main unit 14 for providing control and power functionalities to the massage apparatus 10. Referring to FIG. 4, removable battery compartment 26 may include a control panel 60 for controlling the respective operations of the vibration massage actuator 16 and the squirming/vibration massage actuator 18 when the removable battery compartment 26 is operatively engaged inside body 66 of main unit 14. As shown in FIG. 3, the removable battery compartment 26 may include a battery cartridge 56 having a distal end 99 and a proximal end 101 with compartments 108 defined between ends 99 and 101 for receiving batteries 28 that provide power to the massage apparatus 10.

Figure 2:
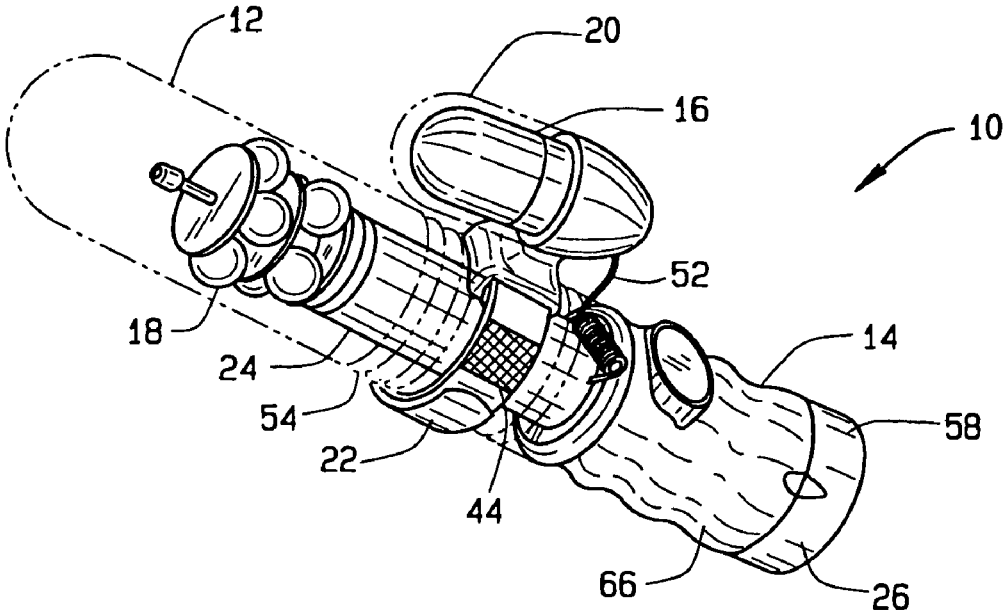
FIG. 2 is a perspective view of the massage apparatus engaged to prosthetic members.

In one embodiment shown in FIG. 2, massage apparatus 10 may be adapted to engage a hollow prosthetic member 12 such that the squirming/vibration massage actuator 18 may be disposed inside prosthetic member 12. As further shown, prosthetic member 12 may define a plurality of annular protrusions 54 around the outer circumference of the prosthetic member 12 which provides a surface for engaging the detachable connecting ribbon 22 to different portions of prosthetic member 12. In addition, a hollow prosthetic member 20 may be adapted to encase vibration massage apparatus 16.

Referring back to FIG. 4, control panel 60 may be made operational when the removable battery compartment 26 is operatively engaged inside main unit 14 as shall be discussed below. Control panel 60 provides a means for operating the various functionalities of massage apparatus 10 and may comprise a base cover 58 engaged to the proximal end 101 of removable battery compartment 26. Base cover 58 may include a resilient panel plate 62 externally fixed to the end face of base cover 58.

As further shown, panel plate 62 defines a plurality of indentations 72 for holding key caps 86 in registration with respective push button switches 82 for controlling the various operations of the vibration massage actuator 16 and squirming/vibration massage actuator 18 when actuated. The resilience of the panel plate 62 allows each respective push button switch 82 to be actuated while also providing a seal that protects the control panel 60 from external damage.

Push button switches 82 may be operatively mounted on a printed circuit board 64 such that actuation of push button switches 82 will operate respective functionalities of the vibration massage actuator 16 and squirming/vibration massage actuator 18. A pair of spring contact metal plates 80 and printed circuit board 64 may be secured between base cover 58 and the proximal end 101 of battery cartridge 56 by screws 100 such that push button switches 82 extend through respective holes 102 defined by base cover 58.

A pair of springs 94 in combination with a respective pair of metal contact plates 96 may be fixed between the distal end 99 of removable battery compartment 26 and a printed circuit board 74 mounted on the battery cartridge 56 by screws 98. Printed circuit board 74 provides a means of locating the contract plates for detachably electrically connecting, when the battery cartridge assembly is inserted into and locked onto body 66, to respectively registrate plates 88 which are connected to the motors' poles disposed inside body 66.

Battery cartridge 56 may define an indentation 104 for engaging a wire harness 76 for providing an electrical circuit connection for metal contact plate 96 to another metal contact plate (not shown) disposed at the proximal end 101 with batteries 28. A stacker 78 may cover the wire harness 76 in order to provide a protective covering for wire harness 76.

As further shown, a plurality of metal contact plates 88 may be mounted on a printed circuit board 70 that provides a means of locating contact plates 88 and circuit connecting between the contact plates and motors. The plurality of contact plates 88 may be positioned to be in corresponding registration with respective metal contact plates 96 and springs 94 when the massage apparatus 10 is assembled. In assembly, the printed circuit board 70 may be mounted inside body 66.

In one embodiment, body 66 of main unit 14 may define a plurality of L-shaped indentations 90 equally spaced around open end 50, while the base cover 58 of the removable battery compartment 26 may define a plurality of corresponding protrusions 84 equally spaced along the inner circumference thereof. As such, the plurality of protrusions 84 may be engaged to the plurality of corresponding indentations 90 when the removable battery compartment 26 is operatively engaged with main unit 14.

When the battery cartridge 56 of the removable battery compartment 26 is fully inserted inside the main unit 14 the plurality of protrusions 84 engage respective indentations 90 such that the user may then twist the removable battery compartment 26 in an opposite direction relative to the main unit 14. As the user rotates the removable battery compartment 26, removable battery compartment 26 becomes locked inside the main unit 14 and the control panel 60 made operational with the massage apparatus 10.

Referring back to FIG. 3, in one embodiment the main unit 14 may define a boss portion 85 adapted to retain a name plate 92 for identifying the manufacturer and/or product if desired.

As shown in FIG. 4, main unit 14 may further define a flange portion 68 adjacent an upper opening 97 such that a hollow tube 24 may be engaged to the main unit 14 and encases driving unit 30 that operates the squirming/vibration massage actuator 18. In one embodiment, driving unit 30 may be an electric motor 53 operatively engaged to a gearbox 55 for providing the squirming and vibration motion of the squirming/vibration massage actuator 18.

In addition, the electric motor 53 may include an eccentric mass 91 that is spun by electric motor 53 through a rotatable motor shaft (not shown) such that a squirming and vibration action is generated by spinning of the eccentric mass 91 which is imparted to the hollow tube 24. As further shown, a rotor guard 37 may be disposed at the lower end of electric motor 53 which surrounds the eccentric mass 91 and provides a separation of the eccentric mass 91 from power cables (not shown) that are connected to respective poles 67. In this manner, the rotation of the eccentric mass 91 does not contact or is otherwise interfered with by the power cables.

The vibration massage actuator 16 may include an electric motor 36 operatively engaged to an eccentric mass 38 through a motor shaft 40 that spins the eccentric mass 38 in a manner that generates a vibration function when operational. In addition, the motor 36 may be encased inside an upper shell 32 engaged to a lower shell 34.

The lower shell 34 may define an aperture 89 that allows cable 52 to communicate with the control panel 60. The lower shell 34 may be adapted to be seated inside carrying base 42 of the detachable connecting ribbon 22. As further shown, the carrying base 42 may include a seat 51 adapted to engage the vibration massage actuator 16. In addition, the carrying base 42 may further include a connection member 41 defining a slot 46 adapted to engage strap 59.

In one embodiment, the vibration massage actuator 16 may be placed in different positions relative to the squirming/ vibration massage actuator 18 by engaging strap 59 of the detachable connecting ribbon 22 around different annular protrusions 54 defined along prosthetic member 12. In this manner, the position of the vibration massage actuator 16 may be changed relative to the fixed position of the squirming/vibration massage actuator 18 as desired by the user.

It should be understood from the foregoing that, while particular embodiments have been illustrated and described, various modifications can be made thereto without departing from the spirit and scope of the invention as will be apparent to those skilled in the art. Such changes and modifications are within the scope and teaching of this invention as defined in the claims appended hereto.

The invention claimed is:

1. A massage apparatus comprising:

a main unit, said main unit being operatively associated with a first massage actuator and a second massage actuator, a hollow prosthetic member adapted to be engaged to said main unit and encase said first massage actuator, said hollow prosthetic member defining a plurality of annular protrusions, and a detachable connecting ribbon engaged to said second massage actuator, said detachable connecting ribbon being adapted for engagement with one or more of said plurality of annular protrusions, wherein said detachable connecting ribbon is engageable with said plurality of annular protrusions such that the position of the second massage actuator may be changed relative to the first massage actuator.

2. The massage apparatus according to claim 1, wherein said main unit defines a chamber adapted to operatively engage a removable battery compartment, said removable battery compartment including at least one battery for providing power to the massage apparatus and a control panel for controlling the operation of said first and second massage actuators when said removable battery compartment is operatively engaged to said main unit.

3. The massage apparatus according to claim 1, wherein said detachable connecting ribbon includes a strap, said strap having a hook-and-loop tape portion for engaging said detachable connecting ribbon to said plurality of annular protrusions.

4. The massage apparatus according to claim 3, wherein said detachable connecting ribbon further includes a carrying base, said carrying base having a connection member defining a slot adapted to engage said strap, said carrying base further including a seat adapted to engage said second massage actuator.

5. The massage apparatus according to claim 1, wherein said second massage actuator is a vibration massage actuator, said second massage actuator including an electric motor, said electric motor having a rotating shaft operatively engaged to an eccentric mass for spinning said eccentric mass.

6. The massage apparatus according to claim 5, wherein said electric motor is encased inside an upper shell engaged to a lower shell, said upper shell and said lower shell being adapted to be encased inside another prosthetic member.

7. The massage apparatus according to claim 2, wherein said second massage actuator is operative engaged to a cable for operatively associating said first massage actuator to said control panel.

8. The massage apparatus according to claim 1, wherein said first massage actuator is a squirming/vibration massage actuator.

9. The massage actuator according to claim 8, wherein said first massage actuator further includes a driving unit, said driving unit including a motor having a rotatable motor shaft operatively engaged for spinning an eccentric mass, said motor being operatively engaged to a gearbox for operating said first massage actuator.

10. A massage apparatus comprising:

a main unit, said main unit operatively associated with a first massage actuator and a second massage actuator, said main unit in operative engagement with a removable battery compartment, said removable battery compartment including a control panel that controls the operation of massage apparatus when the removable battery compartment is operatively engaged to said main unit, a hollow prosthetic member adapted to encase said first massage actuator, said hollow prosthetic member defining a plurality of annular protrusions, and a detachable connecting ribbon engageable to said second massage actuator, said detachable connecting ribbon includes a strap adapted for engagement with said plurality of annular protrusions, wherein said strap may be engaged to any portion of said plurality of protrusions such that the position of the second massage actuator may be changed relative to said main unit.

11. The massage apparatus according to claim 10, wherein said main unit is engaged to a hollow tube that surrounds said first massage actuator.

12. The massage apparatus according to claim 10, wherein said main unit defines a chamber adapted to receive said removable battery compartment.

13. A method of positioning a massage actuator on a massage apparatus comprising:

a) providing a massage apparatus including a main unit, said main unit being operatively associated with a first massage actuator and a second massage actuator, a hollow prosthetic member adapted to be engaged to said main unit and encase said first massage actuator, said hollow prosthetic member defining a plurality of annual protrusions, and a detachable connecting ribbon including a strap, said strap being engaged to a portion of said plurality of annular protrusions for maintaining said second massage actuator in a first position;

b) disengaging said detachable connecting ribbon from said portion of said plurality of annular protrusions; and c) engaging said detachable connecting ribbon to another portion of said plurality of annular protrusions for maintaining said second massage actuator in a second position.

14. The method of positioning a massage actuator according to claim 13, wherein disengaging said detachable connecting ribbon includes disengaging said strap from said portion of said plurality of protrusions.

15. The method of positioning a massage actuator according to claim 13, wherein engaging said detachable connecting ribbon includes engaging said strap to said another portion of said plurality of protrusions.

16. The method of positioning a massage actuator according to claim 14, wherein said strap includes a hook-and-loop portion.

* * * * *

UNITED STATES PATENT AND TRADEMARK OFFICE

CERTIFICATE OF CORRECTION

PATENT NO. : 7,717,867 B2
APPLICATION NO. : 11/581264
DATED : May 11, 2010
INVENTOR(S) : Simon Siu Man Nan It is certified that error appears in the above-identified patent and that said Letters Patent is hereby corrected as shown below:

Col. 2, line 17: “operative” should read -- operatively --

Claim 7, line 62: “operative” should read -- operatively --

Signed and Sealed this
Seventh Day of February, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,717,867 B2
APPLICATION NO. : 11/581264
DATED : May 11, 2010
INVENTOR(S) : Simon Siu Man Nan It is certified that error appears in the above-identified patent and that said Letters Patent is hereby corrected as shown below:

Col. 2, line 17: "operative" should read -- operatively --

Col. 5, line 62 (Claim 7, line 2): "operative" should read -- operatively --

This certificate supersedes the Certificate of Correction issued February 7, 2012.

Signed and Sealed this
Twenty-eighth Day of February, 2012

David J. Kappos

David J. Kappos
*Director of the United States Patent and Trademark Office*